United States Patent [19]

Frye

[11] 4,098,041

[45] Jul. 4, 1978

[54] BURIED SAND ANCHOR FOR VOLLEYBALL POLES AND THE LIKE

[76] Inventor: Norman V. Frye, R.R. #4, Davenport, Iowa 52800

[21] Appl. No.: 776,728

[22] Filed: Mar. 11, 1977

[51] Int. Cl.[2] ..... E02D 5/74

[52] U.S. Cl. ..... 52/155; 248/156; 52/166

[58] Field of Search ..... 52/155–166; 248/156

[56] References Cited

U.S. PATENT DOCUMENTS

| | | | |
|---|---|---|---|
| 589,079 | 8/1897 | Glazier | 52/165 |
| 1,083,582 | 1/1914 | Bates | 52/165 |
| 2,490,355 | 12/1949 | Hubbard | 52/163 |
| 2,738,941 | 3/1956 | Laurich et al. | 248/156 |

FOREIGN PATENT DOCUMENTS

| | | | |
|---|---|---|---|
| 362,665 | 3/1918 | Fed. Rep. of Germany | 52/155 |

*Primary Examiner*—James L. Ridgill, Jr.

[57] ABSTRACT

A perforated tubular member is used as a tool for digging a trench in the sand, in which trench the member is buried and used for supporting a pole for a volleyball or like net, two such members being used for two poles and one net.

1 Claim, 7 Drawing Figures

BURIED SAND ANCHOR FOR VOLLEYBALL POLES AND THE LIKE

BACKGROUND OF THE INVENTION

Outdoor volleyball has rapidly become a popular sport and lately its popularity has spread to beaches and other sandy areas. The readily available portable table volleyball kits — including a pair of ground anchors, poles and a net, although highly satisfactory for use in soil, such as lawns etc., are not always suitable for use in sand because of the differences between sand and the relatively more solid soil. Such prior kits are exemplified by applicant's U.S. Pat. No. 4,009,780 and his several eariler patents, featuring auger-type anchors for "threading" into the ground. It has been found that such anchors do not always provide the solidity and stability in looser soils such as sand, considering that volleyball, properly played, generates significant activity involving "crashing" into the net, etc., thus requiring rugged ground anchors. At the same time, in order to be portable, the anchors must be readily fixed to and removable from the ground.

According to the present invention, each ground anchor is a perforated tubular member, preferably having one end formed as a scoop useful for digging in the sand a trench inclined from the horizontal, in which trench the member is laid and covered and packed with sand, the perforations allowing the sand to enter into the interior of the tube so as to add weight and fix it in place. The perforations also serve to "lock" the tube against movement as it receives forces developed during the play. Further, the tube has a pair of longitudinal stabilizing fins that further prevent rocking of the tube after installation. Because the tube is buried at an angle to the horizontal, it has a pair of further openings in which the lower end of the net pole is inserted so as to hold the pole ultimately upright.

Other features and advantages of the invention will become apparent as the disclosure progresses.

DESCRIPTION OF A PREFERRED EMBODIMENT OF THE INVENTION

The anchor is an elongated tubular member 10, preferably cylindrical and having a perforated or multi-apertured wall. By way of example, a satisfactory tube may be of suitable material such as the well-known PVC plastics product and may be approximately 28" to 30" long and, say, 4" in diameter and having a wall thickness on the order of 3/16". The wall of the tube has a plurality of openings 12, in the case of the example chosen here being circular and about 1½" in diameter.

Figure 1:
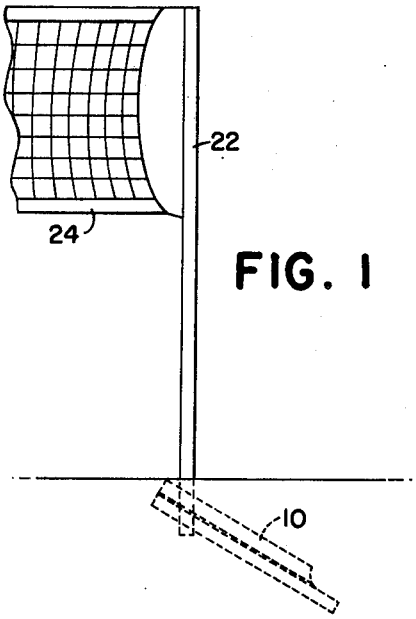
FIG. 1 illustrates an anchor in position and supporting one volleyball pole.
Figure 2:
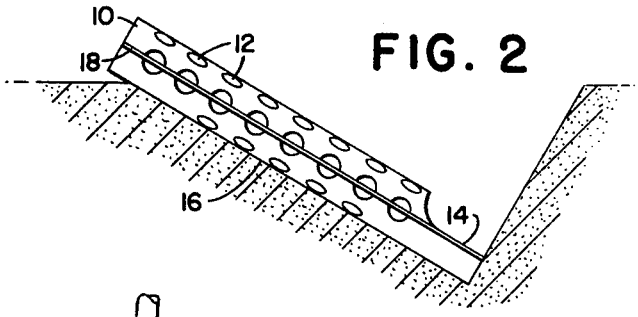
FIG. 2 shows, on a larger scale, the forming of the trench in which the anchor is ultimately buried.

One end of the tube is formed as a scoop 14 to facilitate use of the tube as a tool for digging a sloped trench 16 (FIGS. 1 & 2) in which the tube is ultimately buried. FIG. 1 shows the tube with its scoop end down and its opposite end slightly above the sand, after which the user forces the tube fully into the FIG. 2 position and completely covers it with sand, the sand entering through the openings 14 to fill the interior of the tube and thus to embed it into the sand. The exterior of the tube has a pair of diametrically opposed longitudinal fins or stabilizers 18 to further assist in "locking" the tube against rotation, it being understood that a certain amount of interlock is achieved by virtue of the openings 12.

In addition to the openings 14, the tube has a pair of diametrically alined openings 20 for receiving the lower end of a pole 22 that carries one end of a volleyball or like net 24. Because of the slope of the buried anchor 10, the openings 20 are alined on an axis that is substantially vertical when the anchor is buried. Preferably the openings lie on an axis about five or so degrees off the true vertical so that when the net is tensioned between a pair of poles, the poles are drawn into erect positions. The material of which the tube is formed is capable of flexing or "ovalizing" so that forces encountered during play can be accommodated without loosening the anchor in the sand.

The under portion of the tube at the scoop end, as at 26, is free from openings so as to present a solid bottom for facilitating digging the trench 16. The lower part of the rear or upper end, as at 28, is also without openings (other than the bottom pole opening 20) and the two portions 26 and 28 serve to retain sand. The openings 12 above the scoop end 14 serve as finger holes when the tube is used for digging.

Figure 3:
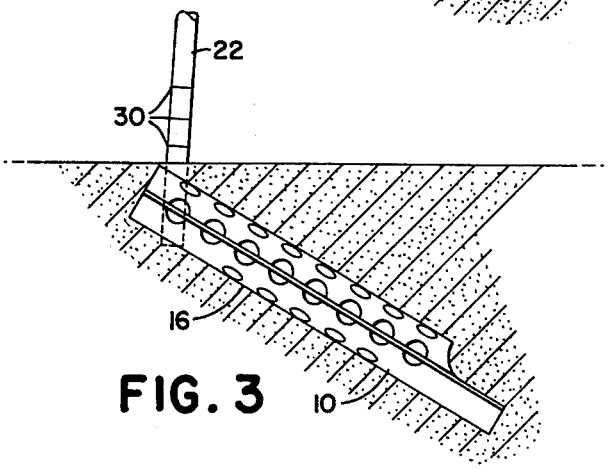
FIG. 3 depicts the buried anchor and the lower part of a pole.
Figure 4:
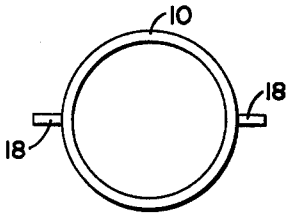
FIG. 4 is an enlarged end elevation of the anchor.
Figure 5:
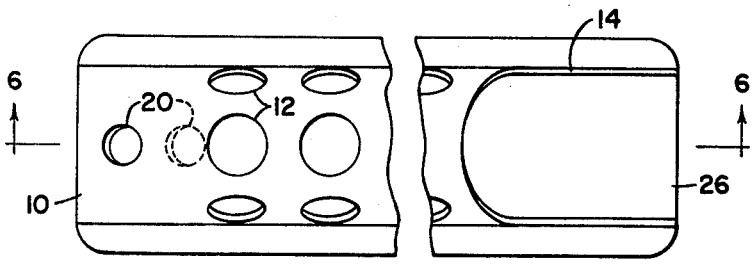
FIG. 5 is a plan, with parts omitted, of the anchor.

Because of the desire to vary pole height for different classes or ages of players, the lower part of each pole bears marks 30 to indicate pole height (FIG. 3).

Figure 7:
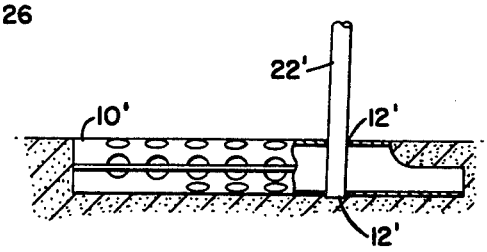
FIG. 7 is a modified form or use of the anchor.
Figure 6:
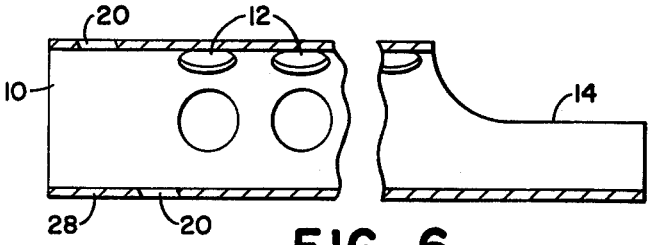
FIG. 6 is a section on the line 6-6 of FIG. 5.

FIG. 7 shows a modified tube 10' which may be buried horizontally for light-duty work, as for holding markers, tables, etc. not subject to the forces encountered in volleyball play, in which case alined openings 12' may be used to receive an upright 22'.

Since the openings 12 allow entry of sand into the tube, the weight of the tube is materially increased, thus adding to its effectiveness as an anchor. The sloped position of FIGS. 1, 2 and 3 puts the anchor at a favorable angle to resist forces tending to rotate the anchor, as when a force lengthwise of the volleyball court is applied.

I claim:

1. An anchor of the class described, comprising: an elongated tubular member open at both ends and adapted to be buried in an inclined position in a pre-dug sloped trench for supporting an upright pole for a volleyball net or the like whereby one end portion of the member is substantially below ground level and the other end portion is adjacent to ground level, said one end portion of the member being formed as a scoop enabling the member to be used as a trench-digging tool, said scoop presenting an upper sand-retaining surface, and said ground-adjacent end portion of the member including pole-supporting means in the form of a pair of apertures respectively through diametrically opposite wall portions of the member, said apertures being aligned on an upright axis substantially perpendicular to the horizontal when the member is buried, said member being formed of a relatively stiff yet slightly flexible material capable of being temporarily "ovalized" and recovering its shape at said ground-adjacent end portion to accommodate at least some of the forces applied to the pole during game usage.

* * * * *